US012049882B2

(12) United States Patent
Szarek

(10) Patent No.: US 12,049,882 B2
(45) Date of Patent: Jul. 30, 2024

(54) CRYOPANEL STRUCTURE FOR A CRYOPUMP

(71) Applicant: Edwards Vacuum LLC, Sanborn, NY (US)

(72) Inventor: Gerald Szarek, Chelmsford, MA (US)

(73) Assignee: Edwards Vacuum LLC, Sanborn, NY (US)

( * ) Notice: Subject to any disclaimer, the term of this patent is extended or adjusted under 35 U.S.C. 154(b) by 0 days.

(21) Appl. No.: 18/004,563

(22) PCT Filed: Jul. 6, 2021

(86) PCT No.: PCT/IB2021/056044
§ 371 (c)(1),
(2) Date: Jan. 6, 2023

(87) PCT Pub. No.: WO2022/009089
PCT Pub. Date: Jan. 13, 2022

(65) Prior Publication Data
US 2023/0250813 A1 Aug. 10, 2023

(30) Foreign Application Priority Data
Jul. 8, 2020 (GB) ..... 2010469

(51) Int. Cl.
*F04B 37/08* (2006.01)

(52) U.S. Cl.
CPC ..... *F04B 37/08* (2013.01)

(58) Field of Classification Search
CPC ..... F04B 37/08; F04B 37/085
See application file for complete search history.

(56) References Cited

U.S. PATENT DOCUMENTS 3,579,998 A * 5/1971 Thibault ..... F04B 37/08 62/55.5
4,341,079 A 7/1982 Bonn
4,466,252 A 8/1984 Hood
(Continued)

FOREIGN PATENT DOCUMENTS

CN 106930924 A 7/2017
GB 2077362 A 12/1981
(Continued)

OTHER PUBLICATIONS

PCT Notification of Transmittal of the International Search Report and the Written Opinion of the International Searching Authority, or the Declaration, PCT International Search Report and PCT Written Opinion dated Sep. 20, 2021 for corresponding PCT application Serial No. PCT/IB2021/056043, 12 pages.
(Continued)

*Primary Examiner* — Lionel Nouketcha
(74) *Attorney, Agent, or Firm* — Theodore M. Magee; Westman, Champlin & Koehler, P.A.

(57) ABSTRACT

A cryopump with a pump inlet; a two stage refrigerator; a first stage array arranged thermally coupled to a first stage of the two stage refrigerator; and a cryopanel structure coupled to a second stage of the two stage refrigerator. Surfaces of the cryopanel structure have portions that are coated portion with an adsorbent material and other portions that are not coated with the adsorbent material.

10 Claims, 2 Drawing Sheets

(56) References Cited

U.S. PATENT DOCUMENTS

| | | | | |
|---|---|---|---|---|
| 4,530,213 | A * | 7/1985 | Kadi | F04B 37/08 62/55.5 |
| 4,691,534 | A * | 9/1987 | Lombardini | F04B 37/08 96/121 |
| 4,763,483 | A * | 8/1988 | Olsen | F04B 37/08 62/383 |
| 5,056,319 | A | 10/1991 | Strasser | |
| 6,155,059 | A * | 12/2000 | Matte | F04B 37/08 62/55.5 |
| 2005/0274128 | A1 | 12/2005 | Kishorenath et al. | |
| 2014/0250923 | A1 | 9/2014 | Takahashi | |

FOREIGN PATENT DOCUMENTS

| | | | |
|---|---|---|---|
| JP | S60222572 | A | 11/1985 |
| JP | 861123775 | A | 6/1986 |
| JP | H02191876 | A | 7/1990 |
| JP | H04159467 | A | 6/1992 |
| WO | 2019099862 | A1 | 5/2019 |
| WO | 2022009088 | A1 | 1/2022 |

OTHER PUBLICATIONS

British Examination Report and Search Report dated Nov. 30, 2020 for corresponding British application Serial No. GB2010468.3, 2 pages.

PCT Notification of Transmittal of the International Search Report and the Written Opinion of the International Searching Authority, or the Declaration, PCT International Search Report and PCT Written Opinion dated Sep. 20, 2021 for corresponding PCT application Serial No. PCT/IB2021/056044, 12 pages.

British Examination Report and Search Report dated Nov. 30, 2020 for corresponding British application Serial No. GB2010469.1, 2 pages.

* cited by examiner

CRYOPANEL STRUCTURE FOR A CRYOPUMP

CROSS-REFERENCE TO RELATED APPLICATION

This application is a Section 371 National Stage Application of International Application No. PCT/IB2021/056044 filed Jul. 6, 2021, and published as WO 2022/009089 A1 on Jan. 13, 2022, the content of which is hereby incorporated by reference in its entirety and which claims priority of British Application No. 2010469.1, filed Jul. 8, 2020.

FIELD

The field of the invention relates to cryopumps and in particular to two stage cryopumps having a first stage at a temperature for capturing type I gases such as water vapour, and a second stage at a lower temperature for capturing type II gases such as Nitrogen and in some embodiments to cryoadsorb type III gases such as hydrogen.

BACKGROUND

A two stage cryopump is formed of a low temperature second stage cryopanel array. This may operate in the range of 4-25 K and may be coated with a capture material such as charcoal. This cryopanel array acts as the primary pumping surface and is surrounded by a first stage radiation shield that operates in a higher temperature range such as of 40-130 K, and provides radiation shielding to the lower temperature array and shields it from type I gases such as water vapour by capturing these gas molecules where they contact the array.

In operation, when gases pass through the inlet into the pump vessel, at least some of the type I gases such as water vapour are condensed on the frontal array, which forms part of the first stage radiation shield. The lower boiling point gases pass through the frontal array and into the volume within the radiation shield. Type II gases, such as nitrogen, condense on the second stage array, while type III gases, such as hydrogen, helium and neon which have appreciable vapour pressures at 4K are adsorbed by an adsorbent such as activated carbon, zeolite or a molecular sieve that coats the second stage cryopanels.

In this way gases entering the pump from the chamber are captured and a vacuum is generated within the pump vessel. One issue with cryopumps is that during operation their ability to capture gas molecules reduces as the capturing surfaces become saturated with gas molecules. Cryopumps are therefore regenerated periodically to release the captured gas molecules.

It would be desirable to provide a two stage cryopump with increased operation time between regeneration.

The discussion above is merely provided for general background information and is not intended to be used as an aid in determining the scope of the claimed subject matter. The claimed subject matter is not limited to implementations that solve any or all disadvantages noted in the background.

SUMMARY

A first aspect provides a cryopump comprising: a pump inlet; a two stage refrigerator; a first stage array thermally coupled to a first stage of said two stage refrigerator; and a cryopanel structure coupled to a second stage of said two stage refrigerator and comprising a plurality of cryopanels;

wherein said plurality of cryopanels each comprise two surfaces, said two surfaces comprising a coated surface that is coated with an adsorbent material and a further surface that is not coated with said adsorbent material; said first stage array comprises a plurality of elements corresponding to said plurality of cryopanels; said plurality of elements being configured to be mounted between said pump inlet and said plurality of cryopanels; wherein each of said plurality of elements extends from a location between a corresponding cryopanel and said pump inlet towards a neighbouring cryopanel and slopes towards said inlet, such that each of said plurality of elements at least partially shields a coated surface of said neighbouring cryopanel from direct impact of a gas molecule passing through said pump inlet.

The inventor of the present invention recognised that a problem with adsorbent coated surfaces in a cryopump is that over time they can become less effective as gas molecules are adsorbed on them. The adsorbent material is provided to capture type III gases and it is important that these gases contact these surfaces and are captured. However, in order to increase the time between regeneration cycles it would be desirable to inhibit any other gases from being captured by the adsorbent that could be condensed on other surfaces. Photoresist for example, is a gas that may be present when the cryopump is being used to evacuate a semiconductor processing chamber and this is adsorbed by the adsorbent surfaces on impact reducing their lifetime between regeneration.

The inventor of the present invention recognised that were some of the surfaces of the second stage cryopanels not to be coated and were gases such as photoresist to impact these surfaces first then they would be condensed on the non coated surfaces before they reached the adsorbent coated surface and thus, the lifetime of the adsorbent coated surface would be increased. Generally a designer of a pump will seek to coat all of the surfaces of the cryopanels as this increases the area covered by adsorbent and increases pumping speed and time between regenerations. However, the design of the pump needs to take account of the surface area that is coated with adsorbent as this reflects the amount of hydrogen that may be adsorbed and has safety feature implications.

Thus, by providing a pump with some surfaces that are not coated, non type III gases may be condensed when they impact these non adsorbent coated surfaces, while the type III gases will bounce off the non coated surfaces and be adsorbed when they impact an adsorbent coated surface. In this way the adsorbent surfaces will adsorb predominantly type III gases and this will increase their effectiveness and the lifetime between regenerations. In effect by allowing at least some of the gases to impact a non coated surface, some of the gases such as photoresist will, never reach a coated surface and the coated surface will be protected from these gases and can be used to almost exclusively pump the type III gases which will bounce off the non coated surface, increasing the time between regenerations and providing a pump whose pumping speed does not degrade unduly over time.

Furthermore by coating the surface on one side of a panel with the adsorbent and leaving the other side uncoated an arrangement that is simple to manufacture is provided. Additionally the arrangement lends itself well to providing one surface that is likely to be hit by molecules entering the inlet and an other surface that is shielded by the frontal array. In this regard, the coated surface is at least partially shielded from molecules entering the inlet by arranging the elements of the first stage array such that they are between the cryopanel and the inlet. A portion (side or edge) of the first stage element that is closest to the respective cryopanel may be in substantially the same longitudinal plane as the cryopanel and may be angled so that it extends in a radial direction towards a radial position of a neighbouring cryopanel. In this way the element extends over one side (the coated side) of the cryopanel between the cryopanel and the inlet protecting that side from gas molecules entering through the inlet.

As the pump has a reduced coated surface area compared to one where all of the cryopanel surfaces are coated, the theoretical maximum amount of hydrogen that may be adsorbed by the surfaces is correspondingly reduced. Pumps have safety features that relate to the maximum amount of hydrogen that they might adsorb so reducing this maximum value, renders these designed safety features less onerous. Although the theoretical maximum amount of hydrogen that can be adsorbed has been reduced, as at least some of the non-type III gases such as photoresist will condense on the bare surfaces rather than on the adsorbent surfaces, and so the actual amount of hydrogen that the pump does adsorb during operation may be similar to that of a pump with fully coated surfaces.

Thus, an improved pump where the pumping speed does not reduce unduly over time can be provided if only a subset of the surfaces are coated.

Although the first stage array may be at the same temperature as the second stage array, in some embodiments the first stage array is at a warmer temperature than the second stage array and is configured for pumping gasses such as water vapour, the second stage array pumping gasses that condense at a lower temperature such as nitrogen.

In some embodiments, said cryopanel structure is configured and mounted such that a surface of said cryopanel structure that a molecule entering said cryopump is most likely to impact first is said further portion of said cryopanel structure surface.

Where the cryopanel structure is arranged such that the surfaces not coated with an adsorbent is most likely to be hit by molecules entering the pump first then molecules that are condensed on this structure, such as photoresist molecules, will never reach the absorbent surfaces, while type III gasses will bounce off the bare surfaces and if they later impact the coated surfaces will be captured by the absorbent surface. In this way, the absorbent surface can be used to almost exclusively capture molecules that do not condense at these temperatures and the effective lifetime of the adsorbent surface will be increased.

In some embodiments, said first stage array and said cryopanel structure are configured such that there is no line of sight path between said pump inlet and said coated portion of said surface of said cryopanel.

Advantageously the cryopanel structure may be arranged such that there is no line of sight path between the pump inlet and the coated portion of the surface making it very unlikely that the first surface that a molecule entering the pump will impact is the coated structure of the cryopanel. Thus, the coated structure will generally only receive molecules that have already impacted an uncoated surface, and in this way they will be protected from gasses that condense on uncoated surfaces such as photoresist.

In some embodiments, said plurality of cryopanels comprise a plurality of planar cryopanels, one side of said cryopanels comprising said coated surface and the other side comprising said further surface.

In other embodiments, said plurality of cryopanels comprise a plurality of coaxial cylindrical cryopanels of different diameters.

In some embodiments, an outer surface of said cylindrical cryopanels comprise said coated surface and an inner surface comprise said further surface.

The cryopanel structures may be planer. In some embodiments the planer structure may have one coated surface and one non-coated surface. In other embodiments, the structure may form a coaxial cylindrical arrangement. In some embodiments the inner surface of the cylinders is the non-coated surface and the outer surface is the coated surface, the cryopanels being arranged such that gaseous molecules entering the pump inlet impact the inner surfaces and where they are not condensed bounce off and hit a facing outer surface of the coaxial cylinders.

In some embodiments, said plurality of elements are configured to overlap when viewed through the inlet such that gas molecules will hit one of the plurality of elements before hitting the cryopanel structure. The arrangement of the elements may be such that gas molecules that bounce off the elements will be directed towards the non-coated surface providing further protection for the coated surface.

In some embodiments, said plurality of elements of said first stage array comprise a plurality of coaxial frustoconical elements of different diameters.

Where the cryopanel structure comprises cylindrical elements, one arrangement of the first stage array that provides particularly effective protection for one surface of the cylinders. Furthermore, the arrangement is one that fits well with a circular pump inlet.

In some embodiments, said adsorbent material is configured to adsorb type III gases such as hydrogen, helium and neon.

In some embodiments, said adsorbent material comprises a molecular sieve that coats said coated surface.

In some embodiments, said adsorbent material comprises one of: charcoal, activated carbon, zeolite or a porous metal surface.

The absorbent material may be a metal, in some embodiments a porous metal that may be sprayed onto the surface, for example sponge aluminium may be used. Sponge aluminium has a porosity of over 90%.

Further particular and preferred aspects are set out in the accompanying independent and dependent claims. Features of the dependent claims may be combined with features of the independent claims as appropriate, and in combinations other than those explicitly set out in the claims.

Where an apparatus feature is described as being operable to provide a function, it will be appreciated that this includes an apparatus feature which provides that function or which is adapted or configured to provide that function.

The summary is provided to introduce a selection of concepts in a simplified form that are further described in the detailed description. This summary is not intended to identify key features or essential features of the claimed subject matter, nor is it intended to be used as an aid in determining the scope of the claimed subject matter.

BRIEF DESCRIPTION OF THE DRAWINGS

Embodiments of the present invention will now be described further, with reference to the accompanying drawings, in which.

DETAILED DESCRIPTION

Before discussing the embodiments in any more detail, first an overview will be provided.

A second stage cryopanel structure is provided where adsorbent such as charcoal coats the surface on one side of the panel to collect hydrogen, while the other side is bare of adsorbent and will collect other molecules such as photoresist that condenses at the low temperatures of the cryopanels.

In some embodiments, there is a higher temperature (of the order of 80K) frontal array comprising elements that are configured to overlap when viewed through the pump inlet. The amount of overlap will determine the maximum hydrogen pumping speed. In this regard, a large overlap will impede gas flow and reduce pumping speed for the gases not pumped by the frontal array, however, it will protect the second stage array and increase its lifetime between regenerations.

This cryopump will be particularly effective for pumping gases from semiconductor processing such as implant applications, and PVD (physical vapour deposition) applications too.

Embodiments provide a planar and a circular solution. Conventionally a frontal array structure is circular since the pump inlet and interface to the vacuum chamber is circular. A planar frontal array which comprises parallel sloped panels allows the second stage structure to be aligned with the frontal array and this can provide a very high hydrogen pumping speed. The disadvantage is that the full area of the inlet may not be used effectively.

A circular frontal array is better adapted to the circular inlet of the pump and vacuum chamber interface. To provide effective shielding of surfaces of the cryopanel structure by a circular frontal array cylindrical cryopanels may be used. The circular frontal array may advantageously be formed of overlapping frustoconical elements. The internal surfaces of the cylindrical cryopanels may be bare and molecules deflected by these surfaces will impact the coated outer surface of the neighbouring coaxial cylindrical structure. This will yield a pump that doesn't degrade or at least has reduced degradation over time for pumping speed.

Figure 1:
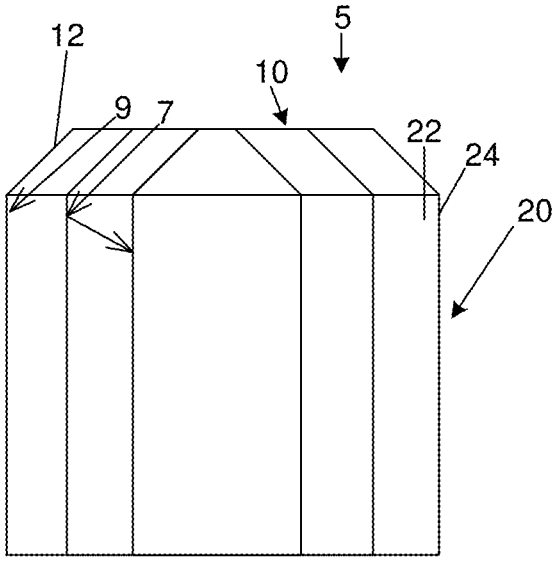
FIG. 1 shows a section through a cryopanel structure of a second stage array and a frontal array of a cryopump of an embodiment.

FIG. 1 shows a coaxial second stage cylindrical cryopanel structure 20 according to an embodiment, that is shielded by a first stage or frontal array 10.

Frontal array 10 comprises a plurality of coaxial frusto conical elements 12 which overlap when viewed through the pump inlet 5.

The plurality of elements 12 which form the frontal array are thermally connected to the first stage refrigerator of the cryopump and are held at a first stage temperature in the range of 40-130K. The upper surface of the frontal array elements 12 that face towards pump inlet 5 are sloped and molecules hitting these surfaces will be captured if they condense at the temperatures of the first stage refrigerator or will be deflected towards the under surface of an outer neighbouring element. The paths between the elements 12 of the first stage array that lead into the pump towards the second stage cryopanel structure are angled towards the inner surface of the cylindrical cryopanels. Thus, molecules travelling along these paths will preferentially impact an inner surface 22 of a cylindrical element of the cryopanel structure when they arrive at the second stage cryopanel structure. If the molecule is a gas that condenses at the temperatures of the second stage array, that is between 4-25 K, such as nitrogen or photoresist the molecule will follow the trajectory shown by arrow 9 and be captured by the inner surface 22. If the molecule is a type III gas molecule that is not condensed at the second stage temperatures then the molecule will follow the trajectory shown by arrow 7 and be deflected by the inner surface 22 of the cylindrical cryopanel element towards an outer surface 24 of a neighbouring inner cylindrical element and will be captured by the adsorbent surface coating the outer surface 24.

In this way the outer surfaces 24 of the coaxial cylindrical second stage cryopanel elements are shielded from gas molecules other than type III gas molecules and thus, the long term effectiveness of the cryopanel structure is improved and pumping speeds do not degrade unduly due to adsorption of molecules such as photoresist.

Figure 2:
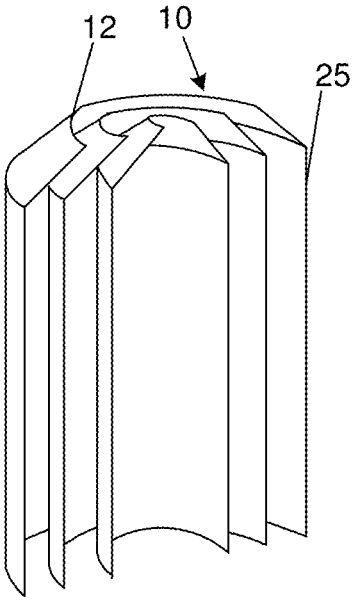
FIG. 2 shows a section of the cryopanel and frontal array structure of FIG. 1 from a different angle.

FIG. 2 shows the same cryopanel structure from a different angle. Here the frusto conical elements 12 of the first stage array 10 can be more clearly viewed extending over the coaxial cylindrical elements 25 that form the second stage cryopanel structure.

Figure 3:
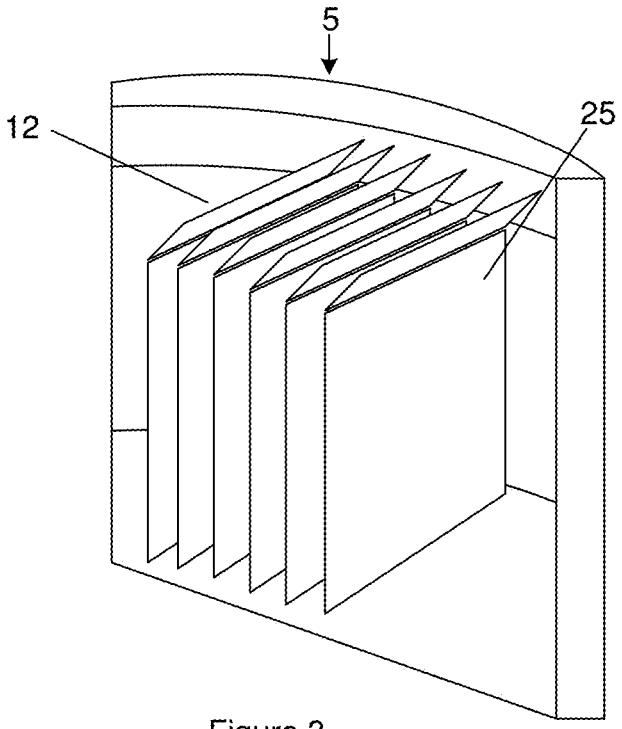
FIG. 3 shows a planar cryopanel structure according to a further embodiment.
Figure 4:
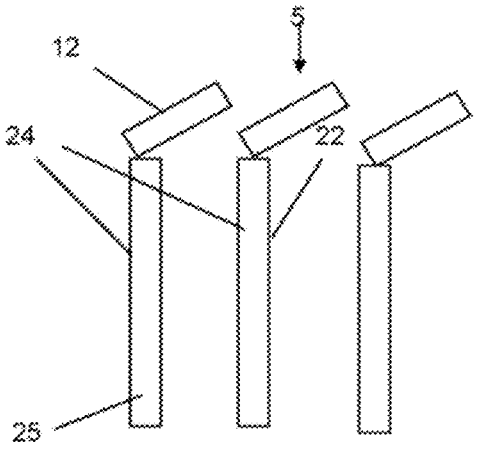
FIG. 4 shows the cryopanel structure of FIG. 3 and the frontal array.

FIGS. 3 and 4 show an alternative embodiment where the two arrays are planar and each are formed of planar elements. The cryopanel structure has parallel panels, one side of which are coated with an adsorbent and the other side not coated. The frontal array comprises sloped elements extending from the elements of the second stage array and sloping towards the pump inlet. In this way they protect the coated surface from initial impact by molecules entering through the pump inlet.

FIG. 3 shows the parallel planar elements 25 of the second stage cryopanel structure within a pump having an inlet 5. The first stage frontal array 12 is shown between planar elements 25 and inlet 5.

FIG. 4 schematically shows the frontal array elements 12 relative to the second stage array elements 25 and pump inlet 5. As can be seen elements 12 are mounted between the pump inlet 5 and the cryopanel structure of the second stage array. They are sloped so that they overlap when viewed from the pump inlet 5 and as for the embodiment of FIGS. 1 and 2, the path between the frontal array elements 12 leads to the bare surface 22 of the cryopanel structure, so that molecules entering through the pump inlet are directed towards this uncoated surface. Thus, initial impact is with bare surface 22 and any molecules that condense at the temperature of the second stage refrigerator are captured. Other type III molecules bounce off surface 22 towards coated surface 24 where they are captured by the adsorbent coating on impact. In this way the coated surface of the second stage elements are shielded by the sloped first stage array element from initial impact by molecules entering the pump. Molecules not condensed on the first stage array or on the second stage array will impact the coated surface and be captured by the adsorbent.

Although illustrative embodiments of the invention have been disclosed in detail herein, with reference to the accompanying drawings, it is understood that the invention is not limited to the precise embodiment and that various changes and modifications can be effected therein by one skilled in the art without departing from the scope of the invention as defined by the appended claims and their equivalents.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

The invention claimed is:

1. A cryopump comprising:

a pump inlet;

a two stage refrigerator;

a first stage array thermally coupled to a first stage of said two stage refrigerator; and a cryopanel structure coupled to a second stage of said two stage refrigerator and comprising a plurality of cryopanels; wherein said plurality of cryopanels each comprise two surfaces, said two surfaces comprising a coated surface that is coated with an adsorbent material and a further surface that is not coated with said adsorbent material;

said first stage array comprises a plurality of elements corresponding to said plurality of cryopanels;

said plurality of elements being configured to be mounted between said pump inlet and said plurality of cryopanels; wherein each of said plurality of elements extends from a location between a corresponding cryopanel and said pump inlet towards a neighbouring cryopanel and slopes towards said inlet, such that each of said plurality of elements at least partially shields a coated surface of said neighbouring cryopanel from direct impact of a gas molecule passing through said pump inlet.

2. The cryopump according to claim 1, wherein two of said plurality of elements define a path directed toward said further surface of said cryopanel structure.

3. The cryopump according to claim 1, wherein said first stage array and said cryopanel structure are configured such that for each coated surface, at least one of the plurality of elements is between the coated surface and said pump inlet along all lines of sight between the coated surface and the pump inlet.

4. The cryopump according to claim 1, wherein said plurality of cryopanels comprise a plurality of planar cryopanels, one side of said cryopanels comprising said coated surface and the other side comprising said further surface.

5. The cryopump according to claim 1, wherein said plurality of cryopanels comprise a plurality of coaxial cylindrical cryopanels of different diameters.

6. The cryopump according to claim 5, wherein an outer surface of said cylindrical cryopanels comprise said coated surface and an inner surface comprise said further surface.

7. The cryopump according to claim 5, wherein said plurality of elements of said first array comprise a plurality of coaxial frustoconical elements of different diameters.

8. The cryopump according to claim 1, wherein said adsorbent material is configured to adsorb type III gases such as hydrogen, helium and neon.

9. The cryopump according to claim 1, wherein said adsorbent material comprises a molecular sieve that coats said coated surface.

10. The cryopump according to claim 1, wherein said adsorbent material comprises one of: charcoal, activated carbon, zeolite or a porous metal surface.

* * * * *